US009975224B2

(12) United States Patent
Tanaka et al.

(10) Patent No.: US 9,975,224 B2
(45) Date of Patent: May 22, 2018

(54) IMPACT WRENCH

(71) Applicants: PANASONIC CORPORATION, Osaka (JP); KUKEN CO., LTD., Osaka (JP)

(72) Inventors: Naotake Tanaka, Osaka (JP); Masari Muramatsu, Osaka (JP); Akinori Nakamura, Osaka (JP)

(73) Assignees: PANASONIC CORPORATION, Osaka (JP); KUKEN CO., LTD., Osaka (JP)

( * ) Notice: Subject to any disclaimer, the term of this patent is extended or adjusted under 35 U.S.C. 154(b) by 650 days.

(21) Appl. No.: 14/301,474

(22) Filed: Jun. 11, 2014

(65) Prior Publication Data

US 2014/0367132 A1 Dec. 18, 2014

(30) Foreign Application Priority Data

Jun. 12, 2013 (JP) ..... 2013-123573

(51) Int. Cl.
*B25B 21/02* (2006.01)

(52) U.S. Cl.
CPC ..... *B25B 21/02* (2013.01); *B25B 21/026* (2013.01)

(58) Field of Classification Search
CPC ..... B25B 19/00; B25B 21/02; B25D 11/04
USPC ..... 173/93, 128, 132
See application file for complete search history.

(56) References Cited

U.S. PATENT DOCUMENTS

| | | | | |
|---|---|---|---|---|
| 3,102,621 | A * | 9/1963 | Van Sittert | B25B 21/02 173/169 |
| 3,908,768 | A * | 9/1975 | Hess | B25B 21/02 173/93 |
| 4,284,148 | A * | 8/1981 | Wanner | B25D 16/00 173/109 |
| 8,490,714 | B2 * | 7/2013 | Nakamura | B25B 21/026 173/93 |
| 9,102,046 | B2 * | 8/2015 | Mattson | B25D 17/02 |
| 9,289,886 | B2 * | 3/2016 | Limberg | B25B 21/026 |
| 2002/0121384 | A1 * | 9/2002 | Saito | B25B 21/02 173/109 |
| 2010/0071923 | A1 * | 3/2010 | Rudolph | B25B 21/00 173/48 |
| 2012/0073845 | A1 * | 3/2012 | Nakamura | B25B 21/00 173/93.5 |

(Continued)

FOREIGN PATENT DOCUMENTS

JP 4457170 4/2010

*Primary Examiner* — Thanh Truong
*Assistant Examiner* — Dariush Seif
(74) *Attorney, Agent, or Firm* — Wenderoth, Lind & Ponack, L.L.P.

(57) ABSTRACT

An impact wrench includes a driving unit, a spindle configured to be rotated by the driving unit, an anvil arranged in front of the spindle in a direction of a rotational axis of the spindle, a primary hammer that is capable of rotating about the rotational axis of the spindle and moving in the direction of the rotational axis of the spindle, a secondary hammer having a cylindrical part in which the primary hammer is housed and that rotates synchronously with the primary hammer, the cylindrical part being configured to receive the spindle, and a rotary impact mechanism that impulsively engages the primary hammer with the anvil to rotate the anvil about the rotational axis of the spindle.

4 Claims, 11 Drawing Sheets

(56) References Cited

U.S. PATENT DOCUMENTS

2012/0279736 A1* 11/2012 Tanimoto ..... B25B 21/02
173/2

* cited by examiner

IMPACT WRENCH

TECHNICAL FIELD

The present invention relates to a technique regarding an impact wrench configured to firmly tighten bolts and nuts by applying an impact in the rotational direction of an anvil, using a primary hammer and a secondary hammer, and in particular to a technique in which the secondary hammer is supported by a spindle via a bearing mechanism such as a rolling bearing.

BACKGROUND ART

Conventionally, an impact wrench configured to firmly tighten bolts and nuts with the primary hammer and the secondary hammer while mitigating vibrations in the axial direction without weakening the rotary impact force is known (see, for example, JP 4457170 B).

With the conventional impact wrench disclosed in JP 4457170 B, two configurations are disclosed, namely, a first configuration and a second configuration, as a structure for preventing so-called "precession rotation", in which the rotational axis of the secondary hammer gyrates about the rotational axis of the spindle.

The conventional first configuration is designed to prevent precession rotation by setting the inner diameter of a hole formed in the center of the bottom of the secondary hammer to substantially the same size as the outer diameter of spindle (see FIG. 1 of JP 4457170 B).

Furthermore, the conventional second configuration is designed to prevent precession rotation by supporting a ball bearing for the spindle and a ball bearing for the secondary hammer with a single cylindrical bush that serves as a spacer (see FIG. 5 of JP 4457170 B).

Problem to be Solved by the Invention

The conventional first configuration disclosed in JP 4457170 B has the following problems:

(1) Since the inner diameter of the hole in the bottom of the secondary hammer is set to be substantially equal to the outer diameter of the spindle, friction is generated by the outer circumference of the spindle sliding in the hole in the bottom, and rotational resistance of the secondary hammer increases, leading to a reduction in impact force.

In order to reduce the rotational resistance caused by the friction, the contact area between the hole in the bottom of the secondary hammer and the outer circumference of the spindle can be reduced, but in this case there is the problem that the sliding portion seizes up or wears out in a short time period and thus durability deteriorates.

(2) The secondary hammer and the spindle need to be made of a high-strength material in order to be resistant to the rotary impact force.

On the other hand, in order to prevent seizure or the like and thereby improve durability, the secondary hammer and the spindle need to be made of a material having high lubricating ability.

However, since a material having high lubricating ability typically has a low strength, it is impossible to achieve both satisfactory durability and strength.

(3) Although a gap between the spindle and the secondary hammer needs to be small in order to diminish precession rotation of the secondary hammer, a small gap will cause so-called "center misalignment", in which the axes of components constituting a rotary impact mechanism do not coincide with each other when assembled, due to a manufacturing tolerance, deformation during heat treatment, or the like of the constituent components.

In this case, already at the point in time at which the rotary impact mechanism has been assembled, a radial load is applied to the pivotally supported parts of the spindle and the secondary hammer, increasing friction resistance and decreasing the rotary impact force, and when the impact wrench is used, a load amplified by an impulse is applied to these pivotally supported parts, causing the life of the pivotally supported parts to be shortened.

Also, too large a gap between the spindle and the secondary hammer will cause the problem that precession rotation of the secondary hammer cannot be prevented.

The conventional second configuration disclosed in JP 4457170 B prevents precession rotation of the secondary hammer by rotatably supporting the spindle and the secondary hammer with a case (corresponding to a housing of the present invention) via respective bearings.

However, in this case, bearings having a large inner diameter are needed in order to pivotally support the outer circumferences of the spindle and the secondary hammer, and if standard size bearings are used, the outer diameter of the bearings is larger than the outer diameter of the secondary hammer, resulting in the problem that the outer diameter of the impact wrench is also increased.

In order to prevent these problems, it is necessary to provide a so-called "thin wall ball bearing" whose ratio of outer diameter to inner diameter is smaller than that of a standard ball bearing, as shown in FIG. 5 of JP 4457170 B, but this thin wall ball bearing has the problem of poor distributability and high component cost.

Furthermore, since the spindle and the secondary hammer are supported via the case, center misalignment at the time of assembly is also likely to occur.

SUMMARY OF INVENTION

The present invention is intended to solve the problems of the conventional configuration by arranging a bearing mechanism, such as a rolling bearing, between the secondary hammer and the spindle, and pivotally supporting the secondary hammer with the spindle.

Means for Solving Problem

An impact wrench according to the present invention is an impact wrench including: a driving unit; a spindle configured to be rotated by the driving unit; an anvil arranged in front of the spindle in a direction of a rotational axis of the spindle; a primary hammer that is capable of rotating about the rotational axis of the spindle and moving in the direction of the axis; a secondary hammer having a cylindrical part in which the primary hammer is housed and into which the spindle is inserted, and that rotates synchronously with the primary hammer; and a rotary impact mechanism that impulsively engages the primary hammer with the anvil to rotate the anvil about the axis, wherein a bearing mechanism that is subjected to a load in the radial direction with respect to the rotational axis of the spindle is arranged between the secondary hammer and the spindle, separately from both the secondary hammer and the spindle, and the secondary hammer is pivotally supported by the spindle.

Effects of the Invention

The impact wrench according to the present invention includes a bearing mechanism that is subjected to a load in the radial direction with respect to the rotational axis of the spindle, between the secondary hammer and the spindle, separately from both the secondary hammer and the spindle, and the secondary hammer is pivotally supported by the spindle, thus making it possible to reduce friction resistance of the radial load that occurs due to precession rotation of the secondary hammer by using a bearing having good slidability. Rotational resistance of the secondary hammer is thus reduced, and the primary hammer is enabled to impulsively engage with the anvil while rotating at a higher speed, preventing a reduction in the rotary impact force.

Furthermore, if a slide bearing is selected for the bearing mechanism, cost and durability are well balanced by employing a high leaded bronze slide bearing for soft body tightening in which the use condition of the impact wrench requires tightening with a low load for a prolonged time (for example, tightening in which a deflected steel plate is pressed down gradually with a bolt so as to remove the deflection), and employing a phosphor bronze slide bearing for rigid body tightening in which the use condition of the impact wrench requires tightening with a high load for a short time (for example, tightening in which rigid bodies are firmly tightened with a bolt and a large axial force is generated).

By providing the bearing separately in this way, it is possible to select a bearing that meets durability and cost requirements. Furthermore, since the secondary hammer is pivotally supported by the spindle, it is possible to reduce center misalignment that occurs when the three components, namely, the primary hammer, the secondary hammer, and the spindle are assembled, as compared with the case where the spindle and the secondary hammer are held via a case.

Reduced center misalignment means that precession rotation of the secondary hammer will also not likely occur, and, as a result, the primary hammer moves smoothly in the axial direction, preventing a reduction in the rotary impact force.

Furthermore, since the secondary hammer is pivotally supported by the spindle, it is possible to configure the impact wrench using a rolling bearing that has small inner and outer diameters and a standard size, thus avoiding distributability problems and realizing a reduction in component cost.

DESCRIPTION OF EMBODIMENTS

Hereinafter, embodiments of the present invention will be described in detail with reference to the accompanying drawings.

Figure 4A:
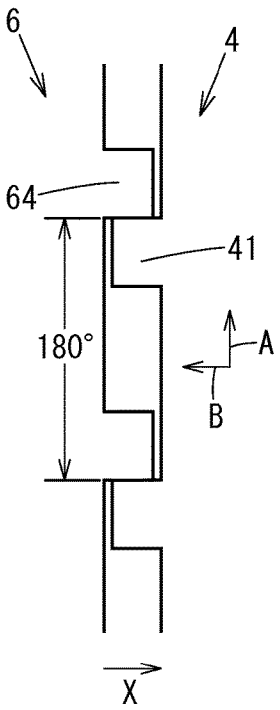
FIGS. 4A, 4B, and 4C are schematic diagrams illustrating a/the state in which outer circumferential surfaces of a primary hammer and an anvil of the impact wrench according to Embodiment 1 of the present invention are developed in the circumferential direction and shown in plan.
Figure 4B:
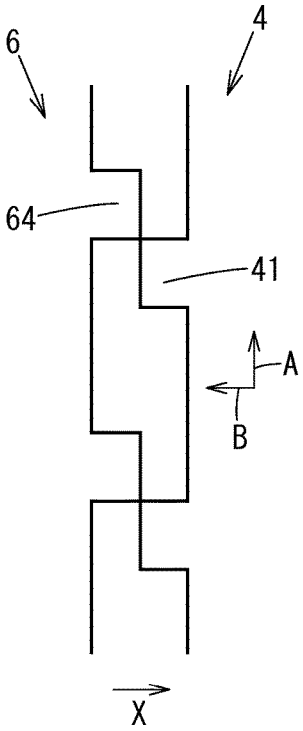
Figure 4C:
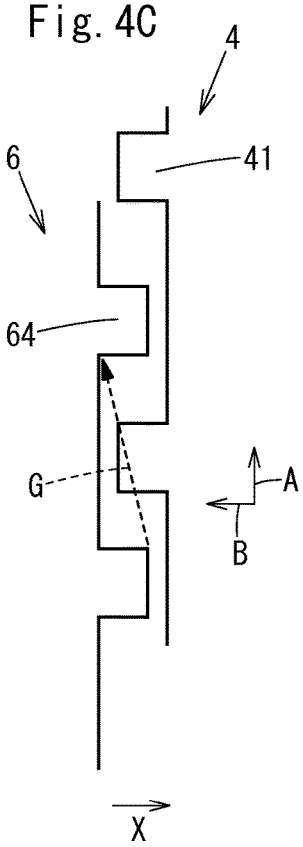
Figure 5:
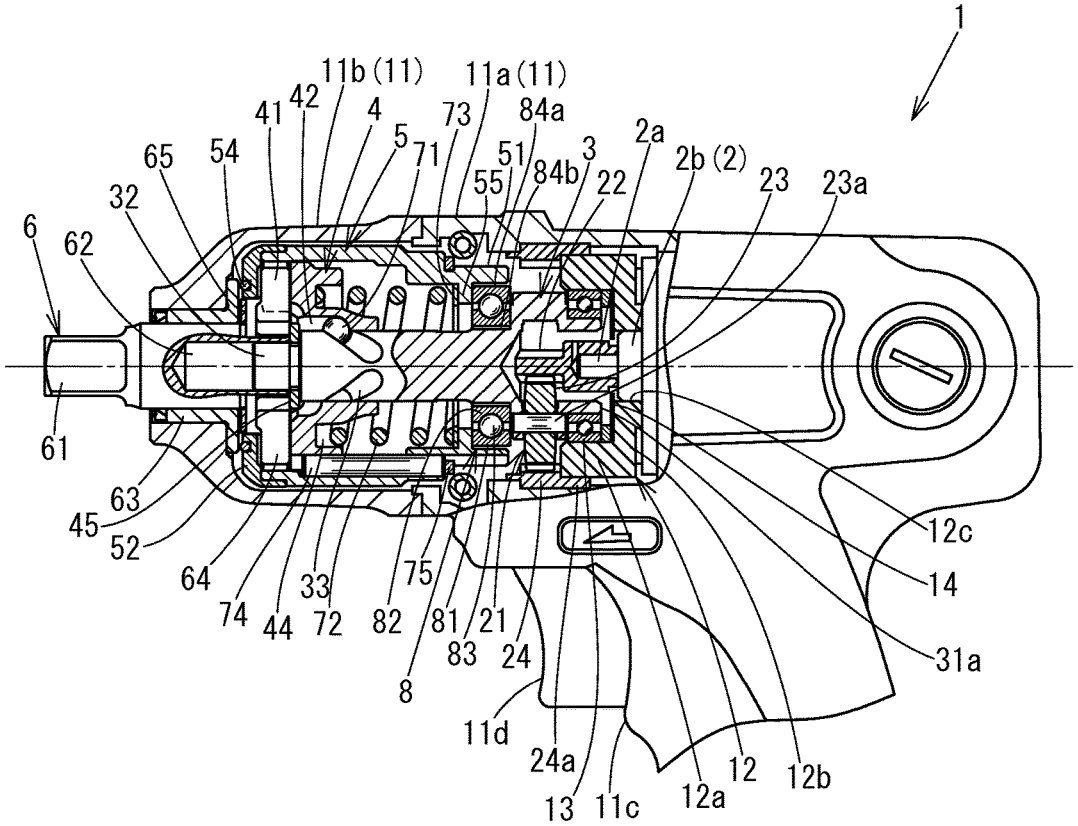
FIG. 5 is a cross-sectional view illustrating a main part of an impact wrench according to Embodiment 2 of the present invention.
Figure 6:
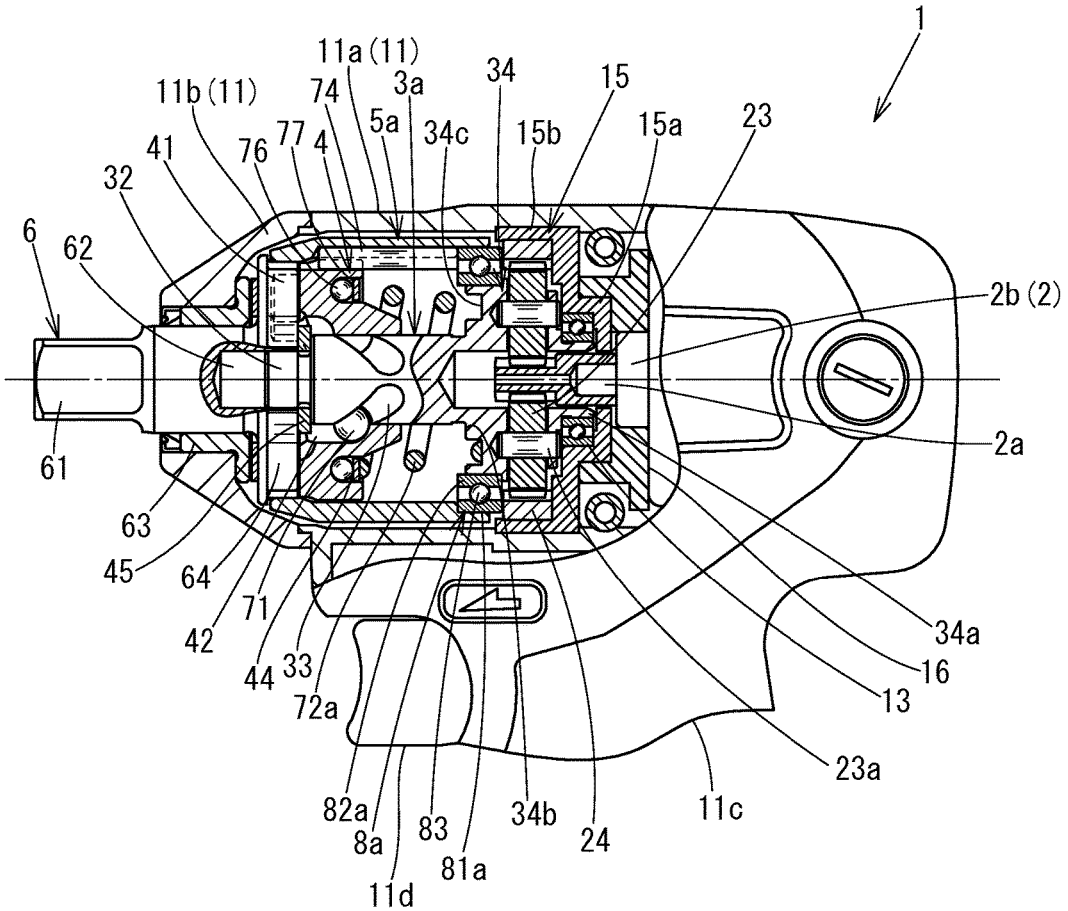
FIG. 6 is a cross-sectional view illustrating a main part of an impact wrench according to Embodiment 3 of present invention.
Figure 7:
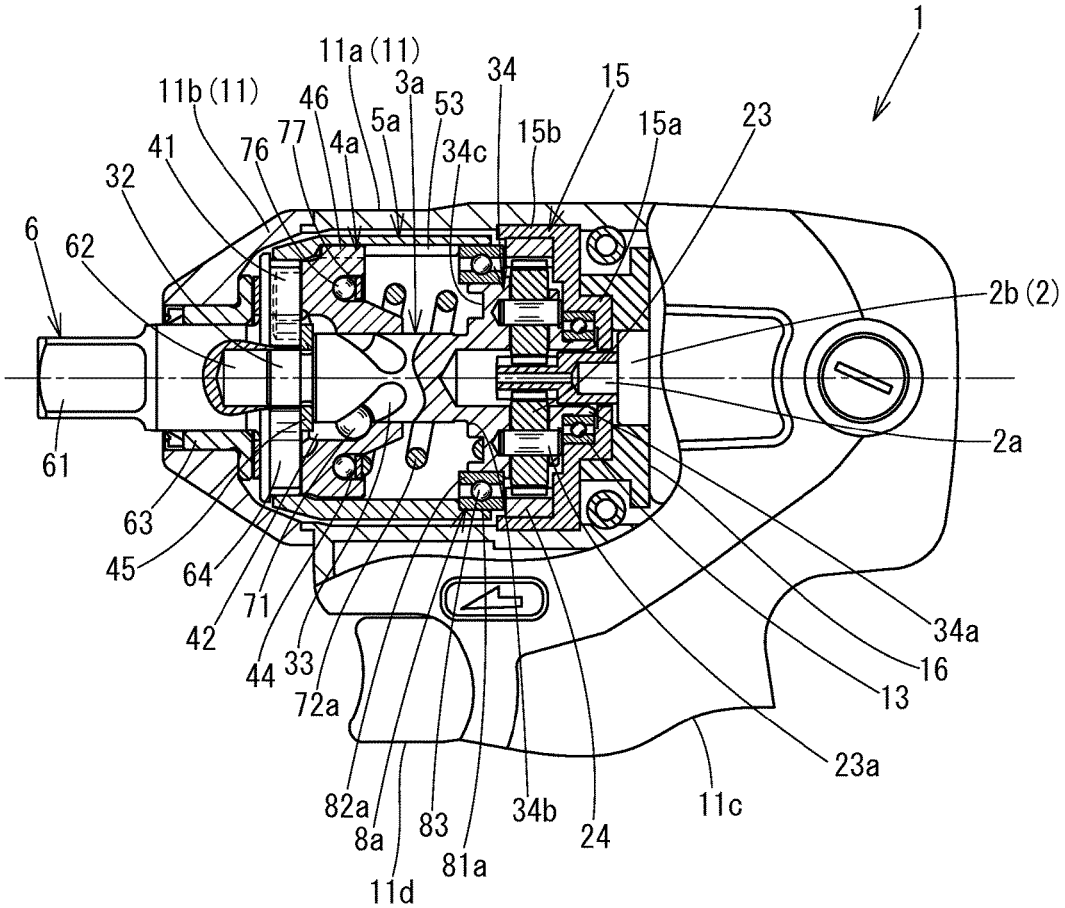
FIG. 7 is a cross-sectional view illustrating a main part of an impact wrench according to Embodiment 4 of the present invention.
Figure 8:
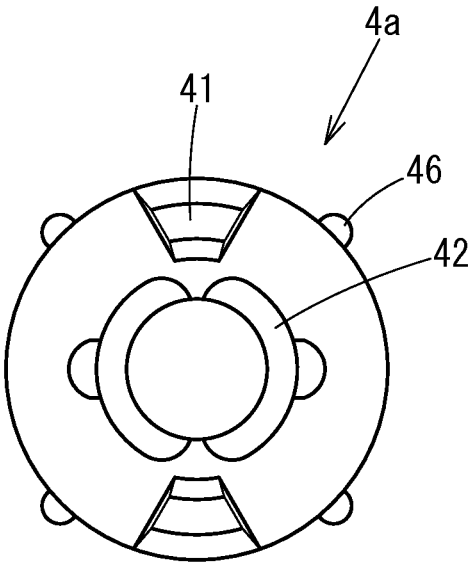
FIG. 8 is a front view illustrating a primary hammer of the impact wrench according to Embodiment 4 of the present invention.
Figure 9:
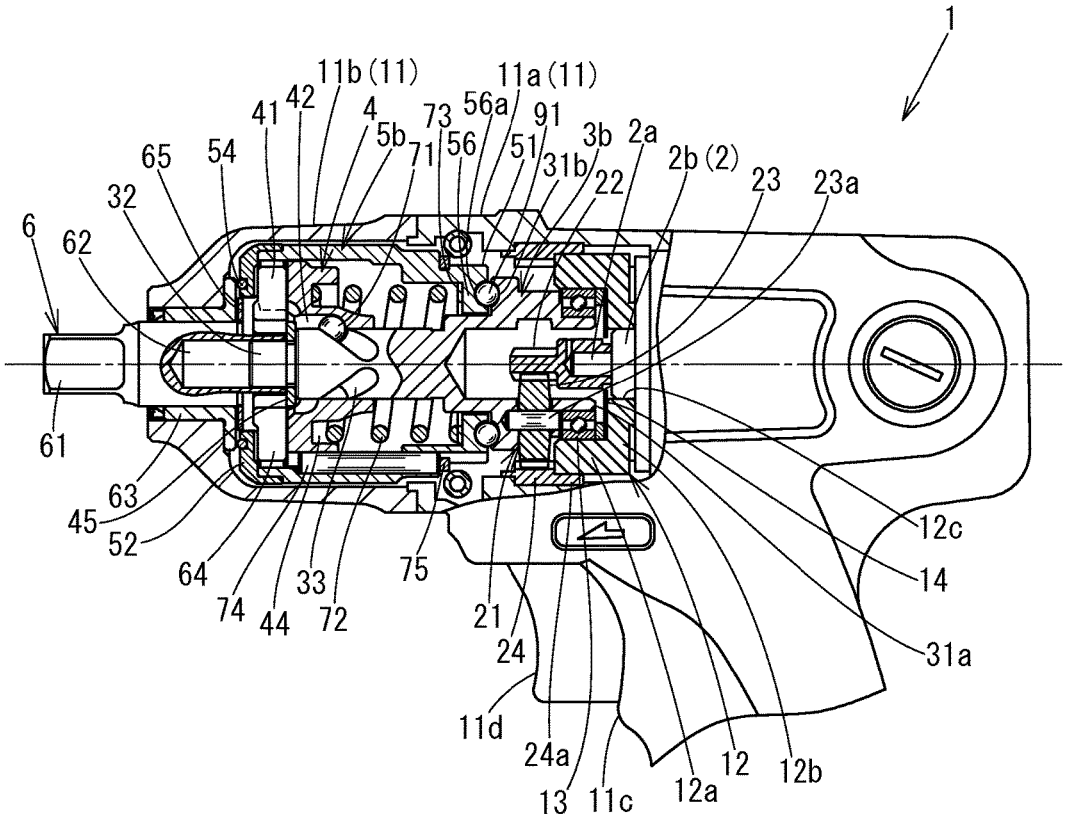
FIG. 9 is a cross-sectional view illustrating a main part of an impact wrench according to Embodiment 5 of the present invention.
Figure 10:
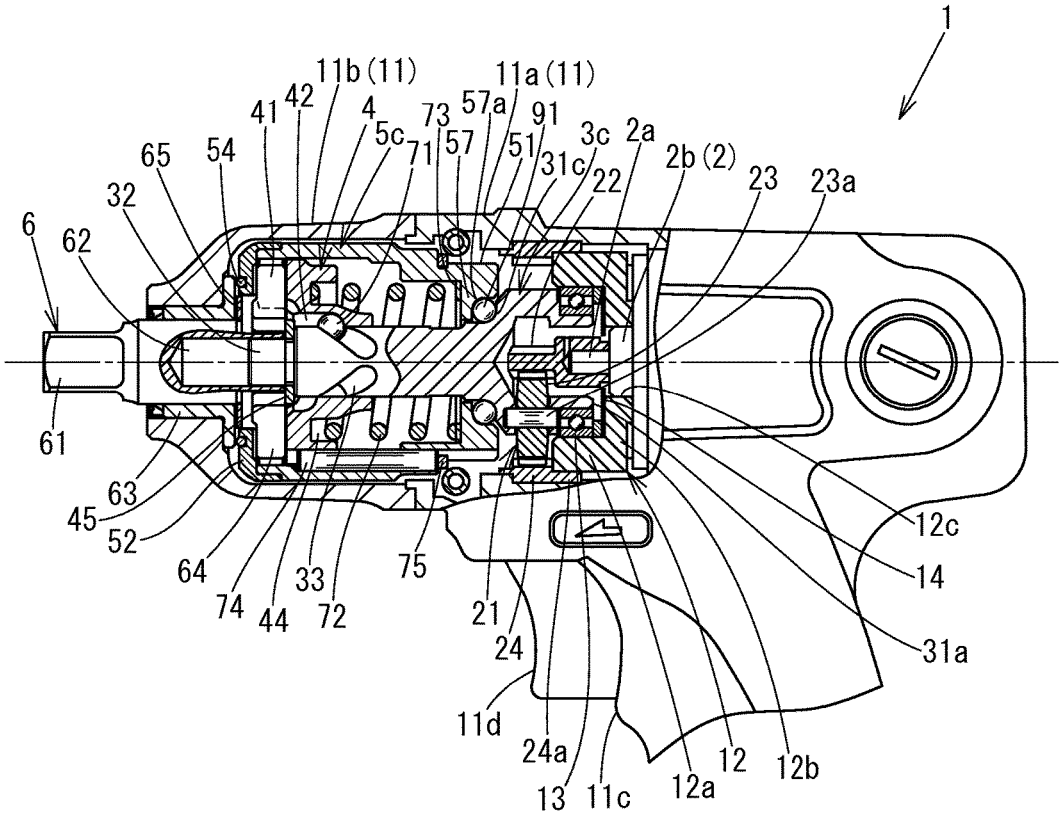
FIG. 10 is a cross-sectional view illustrating a main part of an impact wrench according to Embodiment 6 of the present invention.
Figure 11:
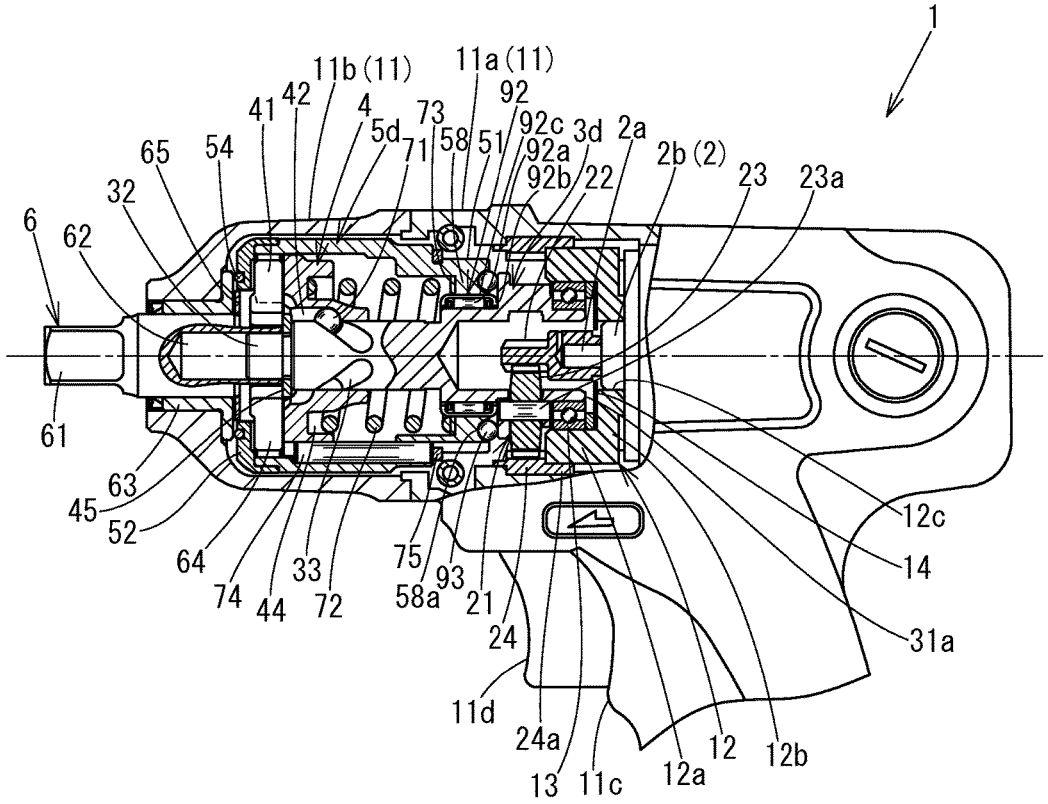
FIG. 11 is a cross-sectional view illustrating a main part of an impact wrench according to Embodiment 7 of the present invention.
Figure 12:
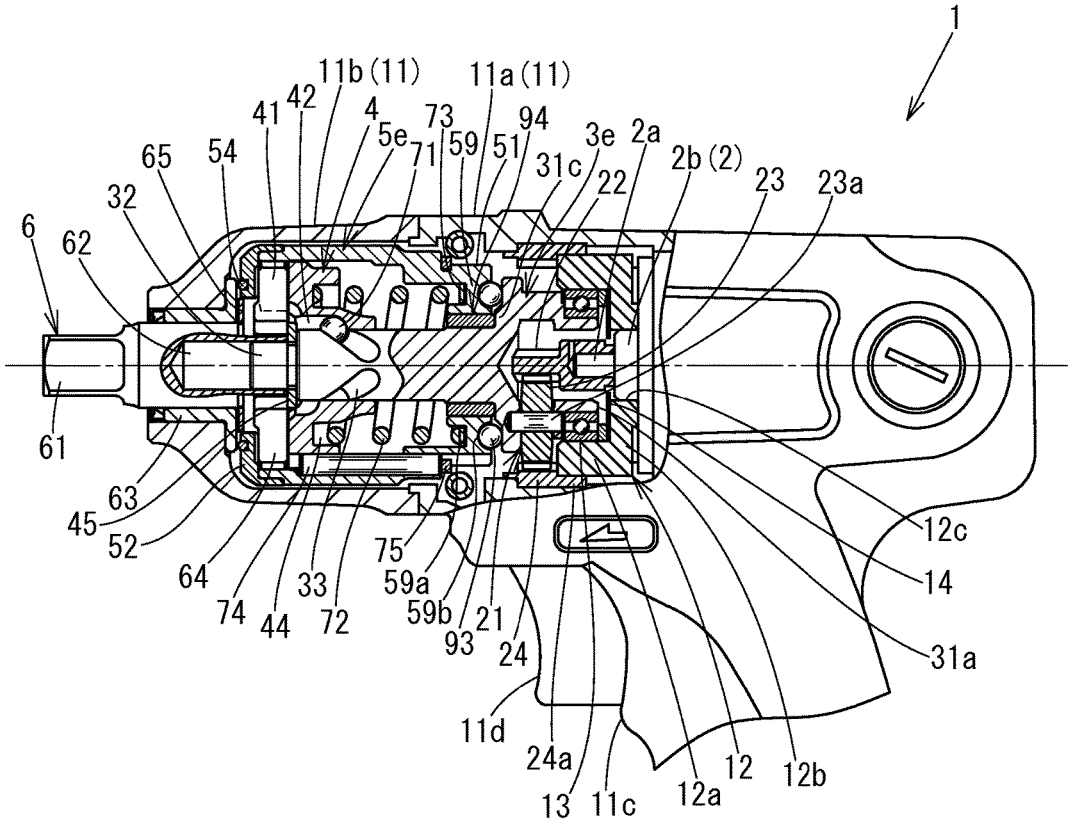
FIG. 12 is a cross-sectional view illustrating a main part of an impact wrench according to Embodiment 8 of the present invention.

FIGS. 1 to 4 are figures relating to Embodiment 1, FIG. 5 is a figure relating to Embodiment 2, FIG. 6 is a figure relating to Embodiment 3, FIGS. 7 and 8 are figures relating to Embodiment 4, FIG. 9 is a figure relating to Embodiment 5, FIG. 10 is a figure relating to Embodiment 6, FIG. 11 is a figure relating to Embodiment 7, and FIG. 12 is a figure relating to Embodiment 8.

Embodiment 1

An impact wrench according to Embodiment 1 of the present invention will be described with reference to FIGS. 1 to 4.

<Schematic Overall Configuration of Impact Wrench>

Figure 1:
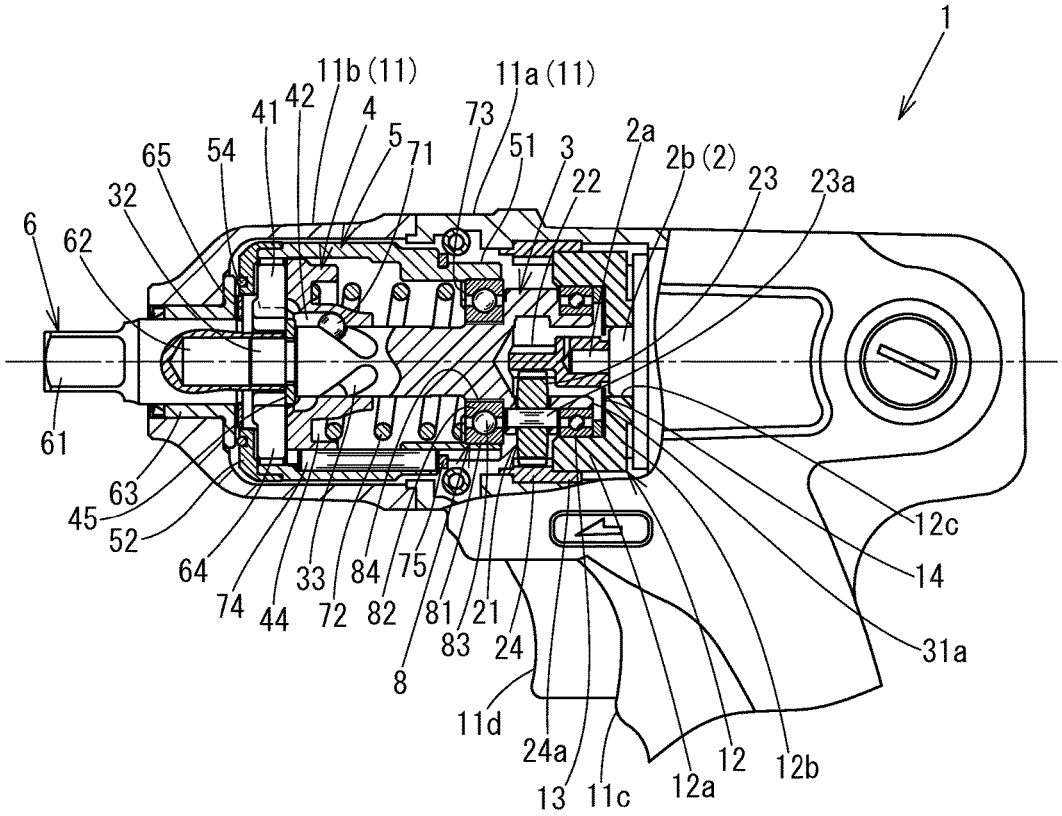
FIG. 1 is a cross-sectional view illustrating a main part of an impact wrench according to Embodiment 1 of the present invention.

In FIG. 1, reference numeral 1 denotes an impact wrench, which includes a housing 11, a driving unit 2, a power transmission mechanism 21, a spindle 3, a primary hammer 4, a secondary hammer 5, and an anvil 6. Hereinafter, the configurations and functionalities of these constituent components will be described.

The housing 11 is constituted by a housing rear part 11*a*, which is arranged in the rear portion of the impact wrench 1 and made of a synthetic resin, and a housing front part 11*b*, which is arranged in the front portion of the impact wrench 1 and made of aluminum.

The housing front part 11*b* is fixed to the housing rear part 11*a* with a plurality of screws (not shown).

The housing rear part 11*a* houses an electric motor, which serves as the driving unit 2, the power transmission mechanism 21, and the like.

Furthermore, a grip 11*c* that is gripped by an operator is provided below the housing rear part 11*a*, and the grip 11*c* has, on its front side, an operation switch 11*d*, and includes, at the lower end of the grip 11*c*, a battery (not shown) serving as a power supply for the electric motor (driving unit) 2.

On the other hand, the housing front part 11*b* houses the spindle 3, the primary hammer 4, the secondary hammer 5, the anvil 6, and the like, which constitute a rotary impact mechanism of the impact wrench 1, and a tool mounting part 61 of the anvil 6 protrudes from an anterior hole of the housing front part 11*b*.

<Power Transmission Mechanism Configuration>

The drive force of a drive axis 2*a* of the driving unit 2 is configured to be transmitted to the spindle 3 via the power transmission mechanism 21.

The power transmission mechanism 21 is constituted by a sun gear 22 fixed to the drive axis 2*a*, three planet gears 23 that engage with the sun gear 22, and an internal gear 24 that engages with the planet gears 23.

Figure 2:
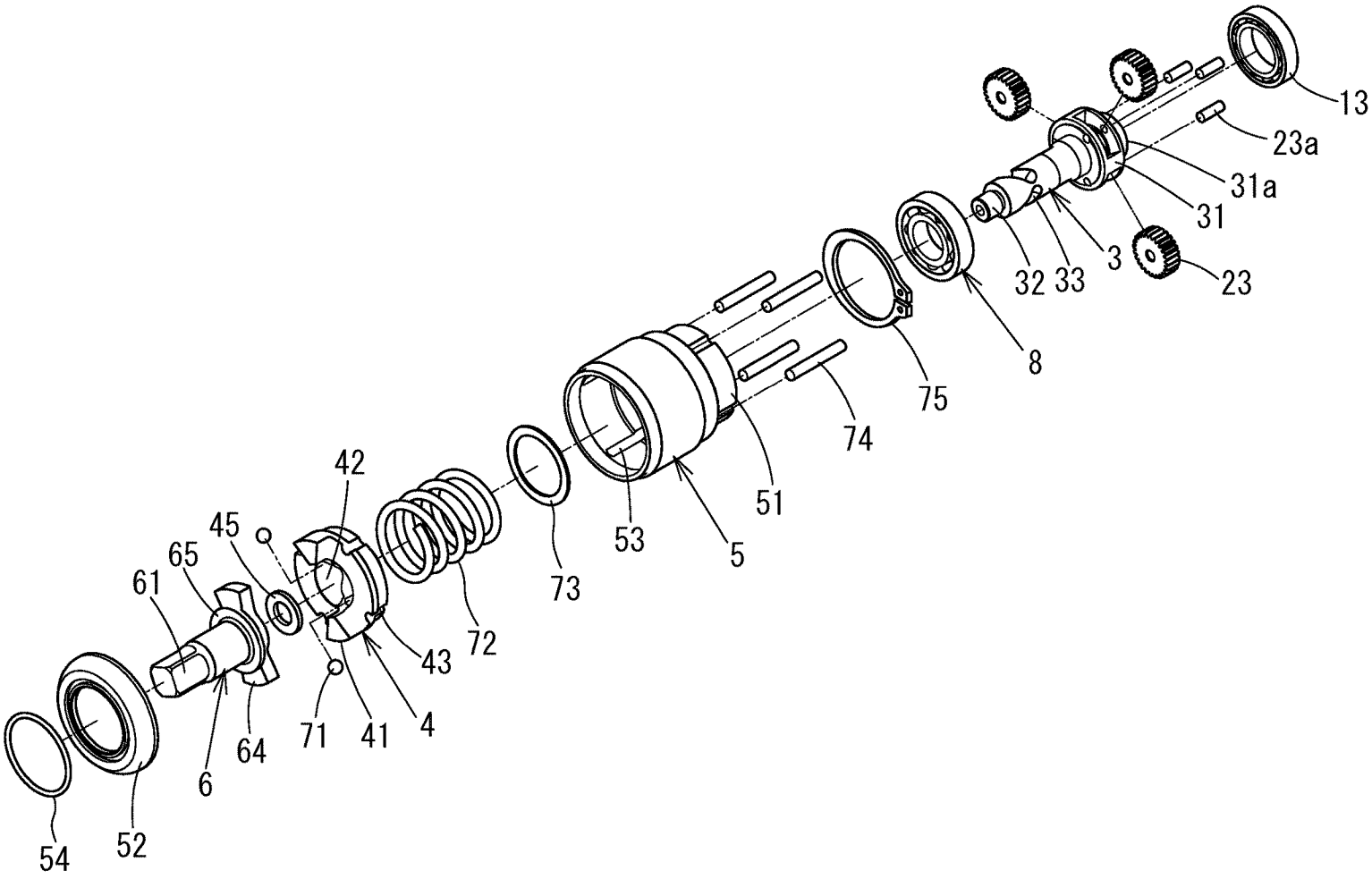
FIG. 2 is an exploded perspective view illustrating constituent components, except for a housing, of the impact wrench according to Embodiment 1 of the present invention.

As shown in FIG. 2, the planet gears 23 are supported by supporting axes 23*a*, which are rotatably mounted to a projecting part 31 that is formed behind the spindle 3.

The internal gear 24 is fixed to the internal surface of the housing rear part 11*a*, as shown in FIG. 1.

Rotation of the driving unit 2 is decelerated by the power transmission mechanism 21 configured in this manner, in relation to a ratio of the teeth number of the sun gear 22 to the teeth number of the internal gear 24 and the torque is increased, and thereby the spindle 3 is driven at low speed and high torque.

<Spindle Configuration>

As shown in FIG. 1, the spindle 3 is rotatably supported via a ball bearing 13 between the outer circumference of a rear end part 31*a* of the projecting part 31 and the inner circumference of a front part 12*a* of a spacer 12.

The spacer 12 is fixed to the housing rear part 11*a* via the internal gear 24 by fixing the outer circumference of the front part 12*a* to the inner circumference of a rear part 24*a* of the internal gear 24.

Furthermore, the spacer 12 has a disk-shaped rear part 12*b*, and supports, in a central hole 12*c* of the rear part 12*b*, a front part 2*b* of the driving unit 2.

The spacer 12 is provided with a metal washer 14 between the disk-shaped part and an outer ring of the ball bearing 13.

The projecting part 31 formed by arranging two ring-shaped flanges with a predetermined distance is provided at the portion of the spindle 3 that is located in front of the ball bearing 13, and between the two flanges of the projecting part 31, the three planet gears 23 are rotatably supported by the supporting axes 23*a*, as described above.

Furthermore, the front part of the spindle 3 is formed in the shape of a column, and at the tip of the column, a cylindrical projection portion 32 having a small diameter is formed coaxially with the axis of the spindle 3.

The projection portion 32 fits rotatably into a hole 62, which is formed in the rear part of the anvil 6 and has a columnar internal space.

<Primary Hammer Configuration>

The primary hammer 4, which is made of steel and has a through-hole in the center, fits the outer circumference of the spindle 3.

The primary hammer 4 has, at its front end, a pair of claws 41 that protrude toward the anvil 6.

Between the primary hammer 4 and the spindle 3 is provided a main part of the rotary impact mechanism, which is capable of rotating about the rotational axis of the spindle 3 and moving in the axial direction, and applies a rotary impact to the anvil 6.

<Rotary Impact Mechanism Configuration>

The rotary impact mechanism includes two first cam grooves 33 formed on the outer circumferential surface of the spindle 3, two second cam grooves 42 formed on the inner circumferential surface of the through-hole of the primary hammer 4, and two steel balls 71 respectively arranged so as to be sandwiched between the first cam grooves 33 and the second cam grooves 42.

The rotary impact mechanism further includes the secondary hammer 5, the anvil 6, and a spring 72 that biases the primary hammer 4 in the direction of the anvil 6. Note that movement of the rotary impact mechanism will be described later with reference to FIGS. 3 and 4.

<Secondary Hammer Configuration>

The steel secondary hammer 5 is arranged on the outer circumferential side of the primary hammer 4, as shown in FIG. 1. The secondary hammer 5 has a cylindrical part in which the primary hammer 4 is housed and into which the spindle 3 is inserted, and that rotates synchronously with the primary hammer 4.

The secondary hammer 5 has, on its rear end side, a small-diameter step part 51 whose outer diameter is small, and the inner circumference of the rear end of the small-diameter step part 51 is press-fitted to an outer ring 81 of a rolling bearing 8.

Furthermore, a ring-shaped cover 52 is fixed to the front end of the secondary hammer 5. A synchronous rotation mechanism with which the secondary hammer 5 and the primary hammer 4 rotate synchronously is provided between both hammers 4 and 5.

<Synchronous Rotation Mechanism Configuration>

As shown in FIG. 2, the synchronous rotation mechanism with which the primary hammer 4 and the secondary hammer 5 rotate synchronously includes, on the outer circumferential surface of the primary hammer 4, four first grooves 43, which each have a semicircular cross-section and are parallel to the rotational axis of the spindle 3.

Furthermore, the synchronous rotation mechanism includes four second grooves 53, which each have a semicircular cross-section, at positions on the inner circumferential surface of the cylindrical part of the secondary hammer 5, the positions corresponding to the first grooves 43.

Moreover, needle rollers, serving as column members 74, fit into holes formed by the first grooves 43 and the second grooves 53 from the rear end side of the secondary hammer 5, and a C-shaped retaining ring 75, which has the function to retain the column members 74, is mounted on the small-diameter step part 51 of the outer circumference on the rear end side of the secondary hammer 5.

The mounting of the C-shaped retaining ring 75 is to facilitate the assembly operation by preventing the column members 74 from inadvertently coming out during assembly of the impact wrench 1.

In this way, by fitting the column members 74 into the holes formed by the first grooves 43 of the primary hammer 4 and the second grooves 53 of the secondary hammer 5, the primary hammer 4 and the secondary hammer 5 rotate synchronously about the rotational axis of the spindle 3.

Furthermore, the primary hammer 4 can move back and forth using the column members 74 as guides. Note that in FIG. 1, the column member 74 and the grooves 43 and 53 are only shown in the lower part of the figure, while illustration thereof in the upper part of the figure is omitted.

In this configuration of the synchronous rotation mechanism of Embodiment 1, the following shortcoming with Embodiment 4, which will be described later, does not occur. That is, in Embodiment 4, the second grooves 53 of a secondary hammer 5*a* have to extend through to the front end side in the case of assembly by inserting a primary hammer 4*a* from the front end side of a secondary hammer 5*a*.

Since the outer circumferential surfaces of claws 64 of the anvil 6 are in contact with the inner circumference of the front end part of a cylindrical part of a secondary hammer 5*a*, the outer circumferential surfaces of the claws 64 of the anvil 6 have to repeatedly come into contact with an arc part formed on the front end part of the cylindrical part of the secondary hammer 5*a* and separate from the arc part at the portion at which the second groove 53 is formed, and get caught on a ridge line portion at the boundary between the arc and the groove, thus preventing the secondary hammer 5*a* from rotating smoothly.

In the case of assembly by inserting the primary hammer from the rear end side of the secondary hammer 5*a*, the inner diameter of the rear end of the secondary hammer 5*a* needs to be larger than the diameter of the primary hammer 4*a*, so it is necessary to use a rolling bearing having a large diameter as the bearing mechanism that is arranged between the secondary hammer 5*a* and a spindle 3*a*, resulting in higher component costs.

<Spring Configuration>

The spring 72 is installed between an annular recess 44, which is formed on the rear side of the primary hammer 4, and the outer ring 81 of the rolling bearing 8 to which the inner circumference of the rear end of the small-diameter step part 51 of the secondary hammer 5 is press-fitted, via the metal washer 73 on the outer ring 81 side, and the primary hammer 4 is biased toward the anvil 6 by the spring 72.

The primary hammer 4, the secondary hammer 5, and the spring 72 synchronously rotate about the axis of the spindle 3.

Accordingly, the spring 72 has a pitch helix whose outer diameter is constant, and the front and rear ends of the spring 72, and the part therebetween synchronously rotate altogether.

Therefore, none of a metal washer and ball for preventing twisting that are required when the rear end of the spring is supported by, for example, the spindle are needed, and the configuration of the rotary impact mechanism is simplified.

<Anvil Configuration>

The anvil 6 is made of steel, and, as shown in FIG. 1, is rotatably supported by the housing front part 11*b* via a slide bearing 63 that is made of steel or brass. The anvil 6 has, on its tip, the tool mounting part 61, which has a square cross-section and is for attaching a socket body that is to be mounted on the head of a hexagon bolt or a hexagon nut.

The anvil 6 has, on its rear part, the pair of claws 64 that engage with the claws 41 of the primary hammer 4.

As shown in FIG. 2, the pair of claws 64 are each formed in the shape of a fan, and the outer circumferential surfaces of the claws 64 are in contact with the inner circumference of the front end part of the cylindrical part of the secondary hammer 5.

The pair of claws 64 of the anvil 6 has the function to hold the center of rotation of the secondary hammer 5.

Note that the claws 64 of the anvil 6 and the claws 41 of the primary hammer 4 do not necessarily constitute respective pairs (two claws), and three or more claws of each type may be provided in the circumferential direction of the anvil 6 and the primary hammer 4 at a regular interval as long as the number of claws of each type are equal to each other.

A ring-shaped flange 65 is provided on the anvil 6 so as to be in contact with the pair of claws 64.

Furthermore, on the outer circumferential side of the flange 65, the ring-shaped cover 52 is arranged so as to cover the open front end of the cylindrical part of the secondary hammer 5, and an O-ring 54 is arranged between the cover 52 and the slide bearing 63 in order to prevent a gap from occurring between the cover 52 and the secondary hammer 5.

<Rolling Bearing Configuration and Effect of Gap>

The following will describe the configuration of the rolling bearing 8, which is a feature of Embodiment 1 of the present invention.

The rolling bearing 8 is a deep-groove ball bearing, and is classed as a radial ball bearing. The rolling bearing 8 includes an inner ring 82, the outer ring 81, a ball 83 serving as a rolling element, and a cage (not shown).

The rolling bearing 8 is arranged between the inner circumference of the rear end of the small-diameter step part 51 of the secondary hammer 5, and the outer circumference of the spindle 3.

Also, the inner circumference of the rear end of the small-diameter step part 51 of the secondary hammer 5 is press-fitted to the outer ring 81 of the rolling bearing 8, and a gap 84 is created between the outer circumference of the spindle 3 and the inner ring 82 of the rolling bearing 8.

Note that, in FIG. 1, the gap 84 is shown exaggerated in size for ease of understanding, and the gap 84 is set to be in the range of 2.0% to 0.2% of the inner diameter of the inner ring 82.

Assuming, for example, that the inner diameter of the inner ring 82 is 30 mm, the gap 84 is set to be in the range of 0.6 mm to 0.06 mm.

The reason why the gap 84 in the range of 2.0% to 0.2% of the inner diameter of the inner ring 82 is arranged between the outer circumference of the spindle 3 and the inner ring 82 of the rolling bearing 8 in this way is to make it possible to reduce the radial load that is to be applied to the pivotally supported part of the rolling bearing 8 due to center misalignment at the time of assembly.

Furthermore, also at the point of use of the impact wrench, it is possible to reduce the radial load with this gap 84, and to extend the life of the rolling bearing 8.

The maximum gap 84 of the above-described range is sufficient for smooth reciprocation of the primary hammer 4 in the axial direction to not be interfered with by the occurrence of precession rotation of the secondary hammer.

Furthermore, the minimum gap 84 of the above-described range is sufficient to enable a difference in rotational speed to be generated between the outer circumference of the spindle 3 and the inner ring 82 of the rolling bearing 8, so that the bearing rotates at a lower speed, thereby enabling the load that is applied to the bearing to be reduced.

Therefore, the created gap 84 is set to be in a range that exhibits an effect of cushioning the radial load caused by center misalignment that occurs when assembling the secondary hammer 5 and the spindle 3, that is, a range in which it is possible to reduce the radial load that is applied to the rolling bearing 8, and, as a result, improve the durability of the rolling bearing 8 and extend the life of the bearing.

<Operation of Rotary Impact Mechanism>

Next, the operation of the rotary impact mechanism of the impact wrench 1 will be described with reference to the above-described FIGS. 1, 3, and 4.

FIG. 4 schematically shows a state in which the outer circumferential surfaces of the primary hammer 4 and the anvil 6 are developed in the circumferential direction and shown in plan. FIG. 4 is used for describing the state of engagement between the claws 41 of the primary hammer 4 and the claws 64 of the anvil 6.

Upon rotation of the driving unit (electric motor) 2, the rotation is decelerated by the power transmission mechanism 21 and then transmitted to the spindle 3, and thereby the spindle 3 rotates at a predetermined number of revolutions.

The rotational force of the spindle 3 is transmitted to the primary hammer 4 via the steel balls 71 fitted between the first cam grooves 33 of the spindle 3 and the second cam grooves 42 of the primary hammer 4.

Figure 3A:
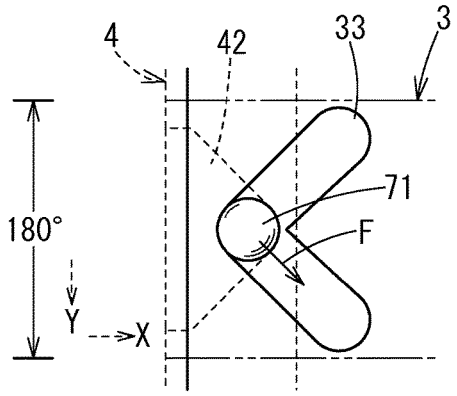
FIGS. 3A and 3B are diagrams illustrating a state in which an outer circumferential surface of a spindle and an inner circumferential surface of the primary hammer of the impact wrench according to Embodiment 1 of the present invention are developed in the circumferential direction and shown in plan (half of the circumference).

FIG. 3A shows the positional relationship between the first cam grooves 33 and the second cam grooves 42 immediately after the start of tightening a bolt, nut, or the like.

FIG. 4A shows a state of engagement between the claws 41 of the primary hammer 4 and the claws 64 of the anvil 6 at the same point of time.

As shown in FIG. 4B, the rotational force A is applied to the primary hammer 4 in the direction indicated by the arrow by rotation of the driving unit 2. Furthermore, the biasing force B in the straight advancing direction is applied to the primary hammer 4 in the direction indicated by the arrow by the spring 72. Note that a small gap exists between the primary hammer 4 and the anvil 6, with this gap being created by a cushioning member 45.

Upon rotation of the primary hammer 4, the engagement between the claws 41 of the primary hammer 4 and the claws 64 of the anvil 6 causes the anvil 6 to rotate, and the rotational force of the primary hammer 4 is transmitted to the anvil 6.

Rotation of the anvil 6 causes the socket body (not shown) attached to the tool mounting part 61 of the anvil 6 to rotate, and thereby initial tightening of a bolt, nut, or the like is performed by application of the rotational force.

When the load torque applied to the anvil 6 increases as the tightening of the bolt, nut, or the like proceeds, that torque causes the primary hammer 4 to rotate in the Y-direction relative to the spindle 3 as shown in FIG. 3A.

Then, the primary hammer 4 overcomes the biasing force B of the spring 72 and moves in the X-direction while the steel balls 71 move in the direction indicated by the arrow F along the inclined faces of the first cam grooves 33 and the second cam grooves 42.

Figure 3B:
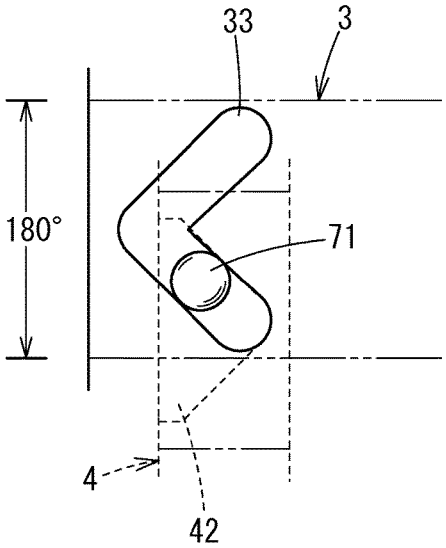

Then, as shown in FIG. 3B, once the steel balls 71 have moved along the inclined faces of the first cam grooves 33 and the second cam grooves 42, and the primary hammer 4 has moved in the X-direction correspondingly, the claws 41 of the primary hammer 4 are disengaged from the claws 64 of the anvil 6 as shown in FIG. 4C.

Upon disengagement of the claws 41 of the primary hammer 4 from the claws 64 of the anvil 6, the biasing force B of the compressed spring 72 is released, and thereby the primary hammer 4 advances at high speed in the direction opposite to the X-direction while rotating in the direction opposite to the Y-direction.

Then, as shown in FIG. 4C, the claws 41 of the primary hammer 4 move along the track indicated by the arrow G and collide with the claws 64 of the anvil 6, and thereby impact force in the rotational direction is applied to the anvil 6.

Thereafter, the claws 41 of the primary hammer 4 move by the reaction in the direction opposite to that of the track G, but are eventually restored in the state shown in FIG. 4A by exertion of the rotational force A and the biasing force B.

By repeating the above-described operation, a rotary impact is repeatedly applied to the anvil 6.

Although the operation for tightening a bolt, nut, or the like has been described above, substantially the same operation as that performed during tightening is performed with the rotary impact mechanism when loosening a tightened bolt, nut, or the like.

In that case, however, the rotation of the driving unit (electric motor) 2 in the direction opposite to that during tightening causes the steel balls 71 to move to the upper right along the first cam grooves 33 shown in FIG. 3A, and the claws 64 of the anvil 6 are struck by the claws 41 of the primary hammer 4 in the direction opposite to that during tightening.

<Action of Secondary Hammer in Rotary Impact Mechanism>

Next, the action of the secondary hammer 5 in a rotary impact will be described in comparison with an impact wrench provided with only the primary hammer. Upon disengagement between the claws 41 of the primary hammer 4 and the claws 64 of the anvil 6, the spring 72 is released from the compressed state, and the energy accumulated in the spring 72 is released as the kinetic energy of the primary hammer 4 and the secondary hammer 5.

As a result of the action of the first cam grooves 33, the second cam grooves 42, and the steel balls 71, the primary hammer 4 advances while rotating at high speed as indicated by the track G shown in FIG. 4C.

Then, the claws 41 of the primary hammer 4 collide with the claws 64 of the anvil 6, and thereby an impulse in the rotational direction is applied to the anvil 6. Also, the front end face of the primary hammer 4 collides with the rear end surface of the anvil 6, and thereby an impulse is applied in the axial direction.

Application of an impact to the anvil 6 by the primary hammer 4 is performed about 40 times per second, and the impulse causes vibrations in a direction orthogonal to the axis of the spindle 3 and in the direction of the axis of the spindle 3.

These vibrations cause fatigue to the operator and lead to reduced operational efficiency as well as hand numbness, and therefore are desirably minimized.

Of these vibrations, vibrations in the direction of the axis of the spindle 3 are mainly caused by the impulse that is applied in the axial direction by the primary hammer 4. On the other hand, the impulse that is applied in the axial direction by the primary hammer 4 does not contribute to tightening of bolts, nuts, and the like.

The strength of the impulse generated by a hammer in the axial direction is proportional to the mass of the hammer, and the strength of impulse in the rotational direction is proportional to the moment of inertia (the sum of the products of the mass of each portion of an object and the square of its distance from the rotational shaft) of the hammer.

In the case of applying a rotary impact to the anvil 6 with the use of a single hammer, it is necessary to decrease the mass of the hammer in order to reduce the impulse in the axial direction.

However, simply decreasing the mass of the hammer results in a reduced moment of inertia and hence a reduced impulse in the rotational direction, and therefore the rotary impact force of the anvil 6 is reduced.

According to the present invention, the above-described problem is solved by using the secondary hammer 5, which is provided separately from the primary hammer 4 fitted to the spindle 3 and rotates synchronously with the primary hammer 4 but does not move in the axial direction of the spindle 3.

That is, the total mass of the primary hammer 4 and the secondary hammer 5 is substantially equal to the mass in the case of using a single hammer, and is set such that the mass of the secondary hammer 5 is greater than the mass of the primary hammer 4.

In this hammer configuration, the impulsive force that is exerted in the rotational direction of the anvil 6 by releasing the spring 72 from the compressed state is proportional to the moment of inertia of the hammers, or in other words, the total moment of inertia of the primary hammer 4 and the secondary hammer 5.

On the other hand, the impulsive force that is exerted in the axial direction by the primary hammer 4 and the secondary hammer 5 is proportional to the mass of only the primary hammer 4.

Therefore, the impulsive force exerted in the axial direction by the primary hammer 4 can be reduced by increasing the mass of the secondary hammer 5, which contributes only to the impulsive force in the rotational direction, as much as possible relative to the mass of the primary hammer 4.

Furthermore, according to the present invention, the moment of inertia is increased by utilizing the fact that the magnitude of the moment of inertia is proportional to the square of the radius of gyration.

That is, the majority of the mass of the secondary hammer 5 having the cylindrical part used in the present invention is concentrated at portions with a larger radius, and the secondary hammer 5 has a larger moment of inertia as compared to cases where a columnar secondary hammer, whose mass is concentrated at the center of rotation, is used, and therefore the impulsive force generated by the secondary hammer is increased.

Accordingly, the use of these hammers (the primary hammer 4 and the secondary hammer 5) according to Embodiment 1 makes it possible to realize an impact wrench 1 in which a large impulsive force is applied in the rotational direction of the anvil 6 and little vibration is generated in the axial direction of the spindle 3.

Embodiment 2

Hereinafter, Embodiment 2 of the present invention will be described with reference to FIG. 5.

Embodiment 2 differs from the foregoing Embodiment 1 in that gaps are provided in both positions between the inner circumference of the rear end of the small-diameter step part of the secondary hammer and the outer ring of the rolling bearing, and between the outer circumference of the spindle and the inner ring of the rolling bearing, and in that the portion of the secondary hammer in which the rolling bearing is arranged has the different shape.

That is, in the foregoing Embodiment 1, the inner circumference of the rear end of the small-diameter step part 51 of the secondary hammer 5 is press-fitted to the outer ring 81 of the rolling bearing 8, and the gap 84 is created between the outer circumference of the spindle 3 and the inner ring 82 of the rolling bearing 8.

<Rolling Bearing Configuration and Effect of Gap>

In this Embodiment 2, gaps 84*a* and 84*b* are created respectively between the inner circumference of the rear end of the small-diameter step part 51 of the secondary hammer 5 and the outer ring 81 of the rolling bearing 8, and between the outer circumference of the spindle 3 and the inner ring 82 of the rolling bearing 8, as shown in FIG. 5.

Similarly to Embodiment 1, the sum of both gaps 84*a* and 84*b* is set to be in the range of 2.0% to 0.2% of the inner diameter of the inner ring 82.

Note that, in FIG. 5, the gaps 84*a* and 84*b* are shown exaggerated in size for ease of understanding.

The effect of the gaps 84*a* and 84*b* of Embodiment 2 is also, similarly to Embodiment 1, to reduce the radial load that is applied to the rolling bearing 8, and, as a result, improve the durability of the rolling bearing 8, and extend the life of the bearing.

Furthermore, in Embodiment 2, a circular flange part 55 is provided on the secondary hammer 5 so as to protrude on the front end surface side of the outer ring 81 of the rolling bearing 8, and positioning of the rolling bearing 8 in the axial direction is performed using that circular flange part 55.

Other configurations of Embodiment 2 are the same as those of Embodiment 1, and thus illustrations and descriptions thereof are omitted.

Embodiment 3

Hereinafter, Embodiment 3 of the present invention will be described with reference to FIG. 6.

Embodiment 3 differs from Embodiment 1 in, for example, the configuration of arrangement of a rolling bearing between the inner circumference of the rear end of the secondary hammer and the outer circumference of the spindle, and in the configuration of a spring that biases the primary hammer toward the anvil, and in that the entire size of the impact wrench in the axial direction is reduced.

Hereinafter, the same reference numerals are given to the same configurations as those of Embodiment 1, and descriptions thereof are omitted or simplified, whereas configuration different from those of Embodiment 1 will be described in detail.

<Rolling Bearing Configuration>

As shown in FIG. 6, on the outer circumference side of the primary hammer 4 of the impact wrench 1 is arranged the steel secondary hammer 5*a*, which has the cylindrical part in which the primary hammer 4 is housed and into which the spindle 3*a* is inserted, and that rotates synchronously with the primary hammer 4.

The secondary hammer 5*a* has the front end part whose outer diameter is reduced in a tapered manner, and the inner circumference of the front end part is in contact with the outer circumferential surfaces of the pair of claws 64 of the anvil 6.

The secondary hammer 5*a* is configured by the cylindrical part that has the constant outer diameter, except for the outer diameter of the front end part, and a press fit structure without a gap is employed between the inner circumference of the rear end of the secondary hammer 5*a* and an outer ring 81*a* of a rolling bearing 8*a*.

Furthermore, the spindle 3*a* is rotatably supported between the outer circumference of a rear end part 34*a* of a projecting part 34 and the inner circumference of a rear part 15*a* of a first spacer 15 via the ball bearing 13.

The inner circumference of a front part 15*b* of the first spacer 15 is fixed to the outer circumference of the internal gear 24, and also the outer circumference of the front part 15*b* is fixed to the housing rear part 11*a*.

Note that reference numeral 16 denotes a second spacer that is provided between the rear part 15*a* of the first spacer 15 and the driving unit 2.

Also, a press fit structure without a gap is employed between the outer circumference of a front end part 34*b* of the projecting part 34 of the spindle 3*a*, and an inner ring 82*a* of the rolling bearing 8*a*.

<Spring Configuration>

A spring 72*a* is installed between the annular recess 44, which is formed on the rear side of the primary hammer 4, and an annular recess 34*c* in the front end part 34*b* of the projecting part 34 of the spindle 3*a*, and the primary hammer 4 is biased toward the anvil 6 by the spring 72*a*.

The spring 72*a* has a pitch helix in the shape of spreading out from the rear part to the front part thereof, and the large diameter side of the pitch helix is arranged in the annular recess 44 of the primary hammer 4 via a plurality of steel balls 76 and metal washers 77, and the small diameter side of the pitch helix is arranged in the annular recess 34*c* of the spindle 3*a*.

Fixation of the two ends of the spring 72*a* in the shape of pitch helix to the respective annular recesses 34*c* and 44 causes twist since the primary hammer 4 and the spindle 3*a* rotate asynchronously, and the twist is prevented by the steel balls 76. Furthermore, the force in the axial direction of the spring 72*a* is applied to the spindle 3*a* and the primary hammer 4, but is balanced out between the spindle 3*a* and the primary hammer 4 via the steel balls 71 fitted between the first cam grooves 33 of the spindle 3*a* and the second cam grooves 42 of the primary hammer 4.

As described above, in this Embodiment 3, only a radial load and not an axial load is applied to the rolling bearing 8*a*.

That is, since the press fit structure is employed between the outer ring 81*a* of the rolling bearing 8*a* and the secondary hammer 5*a*, and between the inner ring 82*a* of the rolling bearing 8*a* and the spindle 3*a*, a radial load caused by center misalignment at the time of assembly is applied to the bearing without being reduced, but no axial load is applied thereto, and, as a result, a dynamic equivalent radial load, which is the sum of the loads of both components, is reduced, making it possible to ensure durability of the bearing.

Note that Embodiment 3 employs the same synchronous rotation mechanism with which the primary hammer 4 and the secondary hammer 5*a* rotate synchronously as that of Embodiment 1.

That is, the primary hammer 4 and the secondary hammer 5*a* rotate synchronously about the axis of rotation of the spindle 3*a* by fitting the column members 74 into holes formed by the first grooves 43 of the primary hammer 4 and the second grooves 53 of the secondary hammer 5*a*.

Embodiment 4

Hereinafter, Embodiment 4 of the present invention will be described with reference to FIGS. 7 and 8.

Embodiment 4 differs from Embodiment 3 in the synchronous rotation mechanism with which the primary hammer and the secondary hammer rotate synchronously.

Hereinafter, the same reference numerals are given to the same configurations as those of Embodiment 3, and descriptions thereof are omitted, whereas the configuration of the synchronous rotation mechanism different from that of Embodiment 3 will be described in detail.

<Synchronous Rotation Mechanism Configuration>

As shown in FIGS. 7 and 8, the primary hammer 4*a* has, on its outer circumference, four linear protrusions 46, which extend in the axial direction and have a semicircular cross-section, and the linear protrusions 46 are formed into one piece with the primary hammer 4*a*. Note that, in FIG. 7, the linear protrusion 46 and the second groove 53 are only shown in the upper part of the figure, while illustration thereof in the lower part of the figure is omitted.

Similarly to Embodiment 3, the secondary hammer 5*a* is provided with the second grooves 53, which engage with the linear protrusions 46 of the primary hammer 4*a*.

As described above, it can be said that, in Embodiment 4, the linear protrusions 46 of the primary hammer 4*a* are provided instead of the first grooves 43 of the primary hammer 4 and the column members 74 of Embodiment 3.

Note that although the number of components can be reduced in this configuration of the synchronous rotation mechanism in Embodiment 4 as compared with the synchronous rotation mechanisms in Embodiments 1 to 3, the following shortcoming described above in Embodiment 1 may occur (see Paragraph "0032" and "0033").

That is, in the case of assembly by inserting the primary hammer 4*a* from the front end side of the secondary hammer 5*a*, the second grooves 53 of the secondary hammer 5*a* have to extend through to the front end side.

Furthermore, since the outer circumferential surfaces of the claws 64 of the anvil 6 are in contact with the inner circumference of the front end part of the cylindrical part of the secondary hammer 5*a*, the outer circumferential surfaces of the claws 64 of the anvil 6 have to repeatedly come into contact with an arc part formed on the front end part of the cylindrical part of the secondary hammer 5*a* and separate from the arc part at the portion at which the second groove 53 is formed, and get caught on a ridge line portion at the boundary between the arc and the groove, thus preventing the secondary hammer 5*a* from rotating smoothly.

Furthermore, in the case of assembly by inserting the primary hammer from the rear end side of the secondary hammer 5*a*, the inner diameter of the rear end of the secondary hammer 5*a* needs to be larger than the diameter of the primary hammer 4*a*, so it is necessary to use a rolling bearing having a large diameter as the bearing mechanism that is to be arranged between the secondary hammer 5*a* and the spindle 3*a*, resulting in higher component costs.

Embodiment 5

Hereinafter, Embodiment 5 of the present invention will be described with reference to FIG. 9.

Embodiment 5 differs from Embodiment 1 in that a plurality of spherical rolling elements are used as bearing mechanisms, in that a modified configuration is employed for the portions of the secondary hammer and the spindle where the rolling elements are arranged, and in that a modified configuration is employed for the arrangement of a spring that biases the primary hammer in the direction of the anvil.

Hereinafter, the same reference numerals are given to the same configurations as those of Embodiment 1, and descriptions thereof are omitted or simplified, whereas configuration different from those of Embodiment 1 will be described in detail.

<Bearing Mechanism Configuration Using Spherical Rolling Element>

A secondary hammer 5*b* has, on its rear end side, the small-diameter step part 51 whose outer diameter is small, and has, on the rear end of the small-diameter step part 51, a circular flange 56, which protrudes inward.

Furthermore, an annular recess 56*a* is formed on the rear side end surface of the flange 56 of the secondary hammer 5*b*, and an annular recess 31*b* is formed on the front side end surface of the projecting part 31 of the spindle 3*b* that faces the rear side end surface of the flange 56.

A plurality of spherical rolling elements 91 are sandwiched between both recesses 56*a* and 31*b*. The plurality of rolling elements 91 are provided on the entire circumferences of the annular recesses 56*a* and 31*b* with a small space remaining therebetween, and can freely roll.

The spring 72, which biases the primary hammer 4 in the direction of the anvil 6, is arranged between the front side end surface of the flange 56 of the secondary hammer 5*b* and the annular recess 44 formed on the rear side of the primary hammer 4.

The spring 72 biases the flange 56 of the secondary hammer 5*b* in the direction opposite to the direction of the anvil 6 with the reaction force generated by the spring 72 biasing the primary hammer 4.

Since the biasing force of the spring 72 is applied, as a load in the axial direction, that is, a preload, to the rolling elements 91 sandwiched between both annular recesses 56*a* and 31*b*, it is possible to further regulate the movement of the secondary hammer in the radial direction with respect to the rotational axis of the spindle, thereby preventing the occurrence of precession rotation of the secondary hammer.

Rolling elements that are made of steel, ceramic, engineering plastic, or the like may be used as the spherical rolling elements 91.

Since, in this Embodiment 5, the bearing mechanism can be constituted mainly by the spherical rolling elements, cost-cutting and simple assembly of the impact wrench 1 are possible by reducing the number of constituent components.

Embodiment 6

Hereinafter, Embodiment 6 of the present invention will be described with reference to FIG. 10.

Embodiment 6 employs a plurality of spherical rolling elements as the bearing mechanism as with in Embodiment 5, but differs from Embodiment 5 in the configuration of arrangement of the spherical rolling elements between the secondary hammer and the spindle.

Hereinafter, the same reference numerals are given to the same configurations as those of Embodiment 5, and descriptions thereof are omitted or simplified, whereas configurations different from those of Embodiment 5 will be described in detail.

<Bearing Mechanism Configuration Using Spherical Rolling Element>

A secondary hammer 5*c* has, on its rear end side, the small-diameter step part 51 whose outer diameter is small, and has, on the rear end of the small-diameter step part 51, a circular flange 57, which protrudes inward and has a rear corner at the internal end that is an inclined surface at an angle of about 45 degrees.

Furthermore, an annular recess 57*a* is formed on the inclined surface on the rear side of the flange 57 of the secondary hammer 5*c*, and the projecting part 31 of a spindle 3*c* has, on its front side that faces the inclined surface of the flange 57, an inclined surface on which an annular recess 31*c* is formed.

The plurality of spherical rolling elements 91 are sandwiched between both recesses 57*a* and 31*c*.

Similarly to Embodiment 5, the plurality of rolling elements 91 are provided on the entire circumferences of the annular recesses 57*a* and 31*c* with a small space remaining therebetween, and can freely roll.

Also, similarly to Embodiment 5, the spring 72, which biases the primary hammer 4 in the direction of the anvil 6, is arranged between the front side end surface of the flange 57 of the secondary hammer 5*c*, and the annular recess 44 formed on the rear side of the primary hammer 4.

The spring 72 biases the flange 57 of the secondary hammer 5*c* in the direction opposite to the direction of the anvil 6 with the reaction force generated by the spring 72 biasing the primary hammer 4.

The rolling elements 91 sandwiched between both annular recesses 57*a* and 31*c* are subjected to a load in the radial direction of the secondary hammer 5*c*, and to a load of the spring 72 in the axial direction thereof.

Embodiment 7

Hereinafter, Embodiment 7 of the present invention will be described with reference to FIG. 11.

Embodiment 7 differs from Embodiment 5 in that a needle roller bearing that does not include an inner ring is used as the bearing mechanism, and in that steel balls that are subjected to an axial load are provided.

Hereinafter, the same reference numerals are given to the same configurations as those of Embodiment 5, and descriptions thereof are omitted or simplified, whereas configurations different from those of Embodiment 5 will be described in detail.

<Bearing Mechanism Configuration Using Needle Roller Bearing>

A secondary hammer 5*d* has, on its rear end side, the small-diameter step part 51 whose outer diameter is small, and has, on the rear end of the small-diameter step part 51, a circular flange 58, which protrudes inward.

Furthermore, a needle roller bearing 92 including, except for an inner ring, needle rollers 92*a*, a cage 92*b*, and an outer ring 92*c* is arranged on the inner circumference of the inner end surface of the flange 58 of the secondary hammer 5*d*, by press-fitting the outer ring 92*c* to the inner circumference of the inner end surface of the flange 58.

Furthermore, the needle rollers 92*a* of the needle roller bearing 92 directly use the outer circumference of a spindle 3*d* as a raceway surface, and this needle roller bearing 92 does not include an inner ring.

This needle roller bearing 92 can be subjected to a load in the radial direction of the secondary hammer 5*d*, but not to a load of the spring 72 in the axial direction thereof.

Therefore, an annular recess 58*a* is provided on the rear side end surface of the flange 58 of the secondary hammer 5*d*, and a plurality of steel balls 93 are provided between this recess 58*a* and the front side end surface of the spindle 3*d* and subjected to a load in the axial direction.

Embodiment 8

Hereinafter, Embodiment 8 of the present invention will be described with reference to FIG. 12.

Embodiment 8 differs from Embodiment 7 in that a slide bearing is used as the bearing mechanism, and in that a modified configuration is used for the arrangement of the spring on the secondary hammer side.

Hereinafter, the same reference numerals are given to the same configurations of Embodiment 7, and descriptions thereof are omitted or simplified, whereas configurations different from those of Embodiment 7 will be described in detail.

<Bearing Mechanism Configuration Using Slide Bearing>

A secondary hammer 5*e* has, on its rear end side, the small-diameter step part 51 whose outer diameter is small, and has, on the rear end of the small-diameter step part 51, a circular flange 59, which protrudes inward.

Furthermore, a slide bearing 94 is arranged by being press-fitted to the inner circumference of the inner end surface of the flange 59 of the secondary hammer 5*e*.

Furthermore, an annular recess 59*a* is formed on the front side end surface of the flange 59 of the secondary hammer 5*e*.

The spring 72, which biases the primary hammer 4 in the direction of the anvil 6, is arranged between the recess 59*a* of the flange 59 of the secondary hammer 5*e* and the annular recess 44 formed on the rear side of the primary hammer 4.

This slide bearing 94 can be subjected to a load in the radial direction of the secondary hammer 5*e*, but not to a load of the spring 72 in the axial direction thereof.

Accordingly, similarly to Embodiment 7, an annular recess 59*b* is formed on the rear side end surface of the flange 59 of the secondary hammer 5*e*, and a plurality of steel balls 93 are provided between this recess 59*b* and the front side end surface of the spindle 3*e* so as to be subjected to a load in the axial direction.

Note that, with respect to specifications of the slide bearing 94, a high leaded bronze slide bearing is used for soft body tightening in which the use condition of the impact wrench 1 requires tightening with a low load for a prolonged time (for example, tightening in which a deflected steel plate is pressed down gradually with a bolt so as to remove the deflection).

On the other hand, a phosphor bronze slide bearing is used for rigid body tightening in which the use condition of the impact wrench 1 requires tightening with a high load for a short time (for example, tightening in which rigid bodies are firmly tightened with a bolt and a large axial force is generated).

Modification of Embodiment 1

In the foregoing Embodiment 1, the inner circumference of the rear end of the small-diameter step part 51 of the secondary hammer 5 is press-fitted to the outer ring 81 of the rolling bearing 8, and the gap 84 is created between the outer circumference of the spindle 3 and the inner ring 82 of the rolling bearing 8.

As a modification of Embodiment 1, the outer circumference of the spindle 3 may be press-fitted to the inner ring 82 of the rolling bearing 8, and a gap may be created between the inner circumference of the rear end of the small-diameter step part 51 of the secondary hammer 5 and the outer ring 81 of the rolling bearing 8.

Furthermore, similarly to Embodiment 1, the gap in the modification is set to be in the range of 2.0% to 0.2% of the inner diameter of the inner ring 82. The effect of the gap in the modification is also, similarly to Embodiment 1, to reduce the radial load that is applied to the rolling bearing 8, and, as a result, improve the durability of the rolling bearing 8, and extend the life of the bearing.

Modifications of Embodiments 1 and 2

Furthermore, in the foregoing Embodiments 1 and 2, the C-shaped retaining ring 75, which has the function to retain the column member 74, is mounted on the small-diameter step part 51 of the outer circumference on the rear end side of the secondary hammer 5, but the shape of the retaining ring is not limited to the C-shape, and various types of retaining ring may be adopted.

Furthermore, the small-diameter step part may not be provided, and the retaining ring may be mounted on the outer circumference on the rear end side of the secondary hammer.

Modifications of Embodiments 1, 2, and 5 to 8

Although, in the foregoing Embodiments 1, 2, and 5 to 8, the secondary hammers 5, 5*b*, 5*c*, 5*d*, and 5*e* have the small-diameter step part 51, the small-diameter step part is not essential.

Modifications of Embodiments 1 to 3, and 5 to 8

Although, in the foregoing Embodiments 1 to 3, and 5 to 8, the column members 74 are used, the present invention is not limited to the column members, and rod-shaped members such as members whose cross-section is polygonal may be used.

Modification of Embodiments 1 to 4

Although the foregoing Embodiments 1 to 4 have described the case in which a deep-groove ball bearing is used as the rolling bearings 8 and 8*a*, a tapered roller bearing or a cylindrical roller bearing may be used instead of the deep-groove ball bearing, or an angular contact ball bearing, which is classed as a radial ball bearing, may also be used.

Modification of Embodiment 5

Although, in the foregoing Embodiment 5, the annular recess 56*a* is formed on the rear side end surface of the flange 56 of the secondary hammer 5*b*, and the annular recess 31*b* is formed on the front side end surface of the projecting part 31 of the spindle 3*b* that faces the rear side end surface of the flange 56, both of the surfaces may not necessarily be provided with the recesses.

That is, even if either or none of the surfaces is provided with the recess, when the plurality of spherical rolling elements 91 are configured to be subjected to a load in the radial direction and to a load in the axial direction with respect to the axis of rotation of the spindle 3*b*, the biasing force by the spring 72 is applied to the rolling element 91, as a load in the axial direction, that is, a preload, and it is therefore possible to regulate the movement of the secondary hammer 5*b* in the radial direction with respect to the rotational axis of the spindle 3*b*. This makes it possible to prevent the occurrence of precession rotation of the secondary hammer 5*b*.

Modifications of Embodiments 5 and 6

In the foregoing Embodiments 5 and 6, the annular recesses 31*b* and 31*c* are respectively formed on the spindles 3*b* and 3*c*, and the annular recesses 56*a* and 57*a* are respectively formed on the secondary hammers 5*b* and 5*c*, but, instead of those annular recesses, three or more independent recesses may be provided on any one type of the annular recesses of the spindles 3*b* and 3*c*, and the annular recesses of the secondary hammers 5*b* and 5*c*.

Note that, in this modification, the independent recesses may be constituted by a part of a spherical surface, or may be a "countersink", which is constituted by a conical hole.

Of the foregoing embodiments, configurations and effects of the preferred embodiments of the impact wrench according to the present invention will be listed as a summary as follows:

As the first aspect, it is configured such that the bearing mechanism is a rolling bearing including an inner ring and an outer ring, and a gap is created at a position between the inner circumference of the secondary hammer and the outer ring of the rolling bearing or a position between the outer circumference of the spindle and the inner ring of the rolling bearing, and a press fit structure without a gap is employed at the position where the gap is not created, so that it is possible to pivotally support the secondary hammer while suppressing precession rotation of the secondary hammer, and to reduce a radial load that is applied to the pivotally supported part of the rolling bearing due to center misalignment at the time of assembly.

Note that this gap is set to be in the range in which smooth reciprocation of the primary hammer in the axial direction is not interfered with by the occurrence of the precession rotation of the secondary hammer. Furthermore, since the rolling bearing includes an internal gap between the inner ring and the outer ring because of its structure, the effect of reducing the radial load caused by center misalignment at the time of assembly is enhanced. Furthermore, the gap and the internal gap also have a cushioning effect, and can extend the life of the rolling bearing even when a radial load is applied by impulse at the point of use of the impact wrench.

As the second aspect, it is configured such that the gap is set to be in the rage of 2.0% to 0.2% of the inner diameter of the inner ring of the rolling bearing, so that it is possible to accurately set the range of the gap to reduce the radial load that is applied to the rolling bearing and improve the durability of the rolling bearing.

That is, the maximum gap in the above-described range is sufficient for smooth reciprocation of the primary hammer in the axial direction to not be interfered with by the occurrence of precession rotation of the secondary hammer, and the minimum gap in the above-described range is sufficient to enable a difference in rotational speed to be generated between the inner circumference of the secondary hammer and the outer ring of the rolling bearing, or between the outer circumference of the spindle and the inner ring of the rolling bearing, so that the bearing rotates at a lower speed, thereby enabling the load that is applied to the bearing to be reduced.

Therefore, the created gap is set to be in a range that exhibits an effect of cushioning the radial load caused by center misalignment that occurs when assembling the secondary hammer and the spindle, that is, a range in which it is possible to reduce the radial load that is applied to the rolling bearing, and, as a result, improve the durability of the rolling bearing and extend the life of the bearing.

A the third aspect, it is configured such that a gap is created at a position between an inner circumference of the secondary hammer and the outer ring of the rolling bearing and at a position between an outer circumference of the spindle and the inner ring of the rolling bearing, so that, as with the foregoing invention according to preferred Embodiment 1, it is possible to reduce the radial load that is applied to the rolling bearing, and improve the durability of the rolling bearing.

By creating a gap at a position between an inner circumference of the secondary hammer and the outer ring of the rolling bearing and a position between an outer circumference of the spindle and the inner ring of the rolling bearing, it is possible to reduce a radial load that is applied to an pivotally supported part of the rolling bearing due to center misalignment at the time of assembly. Note that these gaps are set to be in a range in which smooth reciprocation of the primary hammer in the axial direction is not interfered with by the occurrence of precession rotation of the secondary hammer.

Furthermore, the gaps and the internal gap also have a cushioning effect, and can extend the life of the rolling bearing even when a radial load is applied by impulse at the point of use of the impact wrench.

As the fourth aspect, it is configured such that the sum of the gaps is 2.0% to 0.2% of the inner diameter of the inner ring of the rolling bearing, similarly to the foregoing invention according to preferred Embodiment 3, so it is possible to accurately set the range of the gap to reduce a radial load that is applied to the rolling bearing and improve the durability of the rolling bearing.

That is, the maximum gap in the above-described range is sufficient for smooth reciprocation of the primary hammer in the axial direction to not be interfered with by the occurrence of precession rotation of the secondary hammer, and the minimum gap in the above-described range is sufficient to enable a difference in rotational speed to be generated between the inner circumference of the secondary hammer and the outer ring of the rolling bearing, and between the outer circumference of the spindle and the inner ring of the rolling bearing, so that the bearing rotates at a lower speed, thereby enabling the load that is applied to the bearing to be reduced.

Therefore, the created gap is set to be in a range that exhibits an effect of cushioning the radial load caused by center misalignment that occurs when assembling the secondary hammer and the spindle, that is, a range in which it is possible to reduce the radial load that is applied to the rolling bearing, and, as a result, improve the durability of the rolling bearing, and extend the life of the bearing.

As the fifth aspect, it is configured such that the bearing mechanism is a plurality of spherical rolling elements, and the rolling elements are subjected to loads in the radial direction and the axial direction with respect to the rotational axis of the spindle, so that it is possible to configure the bearing mechanism only with the rolling elements without a commercially available bearing, and achieve cost-cutting.

As the sixth aspect, it is configured such that a recess is formed on each of opposing end faces of the secondary hammer and the spindle, and the rolling elements are sandwiched between both of the recesses, so that, in addition to the effects of the foregoing invention according to preferred Embodiment 5, easy assembly of the impact wrench is achieved despite the plurality of spherical rolling elements being used.

As the seventh aspect, it is configured such that a plurality of first grooves that are parallel to the rotational axis of the spindle are formed on an outer circumferential surface of the primary hammer, a plurality of second grooves are formed at positions on an inner circumferential surface of the cylindrical part of the secondary hammer, the positions corresponding to the first grooves, rod-shaped members are fitted into holes formed by the first grooves and the second grooves, and a retaining ring having a function to retain the rod-shaped members is attached on an outer circumference of the secondary hammer, so that, in addition to the effects of the foregoing invention according to any one of the preferred embodiments, the rod-shaped members are prevented from inadvertently coming out at the time of assembly of the impact wrench, and the assembly operation is facilitated.

Furthermore, after the preassembly of the rotary impact mechanism, it is possible to visually align the locations of the first grooves and the second grooves, and ease of assembly is enjoyed in that it is possible to easily fit the rod-shaped members, and since the retaining ring is mounted after the rod-shaped members have been fitted, it is possible to prevent the rod-shaped members from being displaced or from coming out even at the point of use of the impact wrench.

Note that in the foregoing invention according to preferred Embodiment 7, the above-described following shortcoming with Embodiment 4 is avoided.

That is, in Embodiment 4, the second grooves of the secondary hammer have to extend through to the front end side in the case of assembly by inserting the primary hammer from the front end side of the secondary hammer.

Furthermore, since the outer circumferential surfaces of the claws of the anvil are brought into contact with the inner circumferential surface of the front end part of the cylindrical part of the secondary hammer, the outer circumferential surfaces of the claws of the anvil have to repeatedly come into contact with an arc part formed on the front end part of the cylindrical part of the secondary hammer and separate from the arc part at the portion at which the second groove is formed, and get caught on a ridge line portion at the boundary between the arc and the groove, thus preventing the secondary hammer from rotating smoothly.

Moreover, in the case of assembly by inserting the primary hammer from the rear end side of the secondary hammer, the inner diameter of the rear end of the secondary hammer needs to be larger than the diameter of the primary hammer, so it is necessary to use a bearing mechanism having a large diameter as the bearing mechanism that is arranged between the secondary hammer and the spindle, resulting in higher component costs.

In the foregoing invention according to preferred Embodiment 7, that shortcoming does not arise.

DESCRIPTION OF REFERENCE NUMERALS

1 Impact wrench
2 Driving unit (electric motor)
3, 3*a*, 3*b*, 3*c*, 3*d*, 3*e* Spindle
31*b*, 31*c* Recess
4, 4*a* Primary hammer
43 First grooves
5, 5*a*, 5*b*, 5*c*, 5*d*, 5*e* Secondary hammer
53 Second groove
56*a*, 57*a* Recess
6 Anvil
74 Column member (rod-shaped member)
75 C-shaped retaining ring (retaining ring)
8, 8*a* Rolling bearing
81, 81*a* Outer ring
82, 82*a* Inner ring
84, 84*a*, 84*b* Gap
91 Spherical rolling element

The invention claimed is:

1. An impact wrench comprising:

a driving unit;

a spindle configured to be rotated by the driving unit;

an anvil arranged in front of the spindle in a direction of a rotational axis of the spindle;

a primary hammer that is capable of rotating about the rotational axis of the spindle and moving in the direction of the rotational axis of the spindle;

a secondary hammer having a cylindrical part in which the primary hammer is housed and that rotates synchronously with the primary hammer, the cylindrical part being configured to receive the spindle; and a rotary impact mechanism that impulsively engages the primary hammer with the anvil to rotate the anvil about the rotational axis of the spindle, wherein a rolling bearing that is subjected to a load in a radial direction with respect to the rotational axis of the spindle is arranged between the secondary hammer and the spindle, separately from both the secondary hammer and the spindle, wherein the secondary hammer is pivotally supported by the spindle, wherein the rolling bearing includes an inner ring and an outer ring, wherein the outer ring is inside one end of the secondary hammer, wherein an outer circumference of the secondary hammer at the one end of the secondary hammer is greater than an outer circumference of the outer ring, and wherein a gap is defined at one of (i) a first position between the inner circumference of the secondary hammer and the outer ring, and (ii) a second position between an outer circumference of the spindle and the inner ring; and the rolling bearing has a press fit structure at the other of the first position and the second position such that no gap is defined at the other of the first position and the second position.

2. The impact wrench according to claim 1, wherein the gap is 2.0% to 0.2% of an inner diameter of the inner ring.

3. The impact wrench according to claim 2, wherein first grooves that are parallel to the rotational axis of the spindle are defined on an outer circumferential surface of the primary hammer, wherein second grooves are defined at positions on an inner circumferential surface of the cylindrical part, the positions corresponding to the first grooves, wherein rod-shaped members are fitted into holes defined by the first grooves and the second grooves, and wherein a retaining ring having a function to retain the rod-shaped members is attached on an outer circumference of the secondary hammer.

4. The impact wrench according to claim 1, wherein first grooves that are parallel to the rotational axis of the spindle are defined on an outer circumferential surface of the primary hammer, wherein second grooves are defined at positions on an inner circumferential surface of the cylindrical part, the positions corresponding to the first grooves, wherein rod-shaped members are fitted into holes defined by the first grooves and the second grooves, and wherein a retaining ring having a function to retain the rod-shaped members is attached on an outer circumference of the secondary hammer.

* * * * *